US011865603B2

(12) United States Patent
Ilinich et al.

(10) Patent No.: US 11,865,603 B2
(45) Date of Patent: Jan. 9, 2024

(54) DEVICE TO REDUCE TOOL MARKS IN INCREMENTAL FORMING

(71) Applicant: Ford Global Technologies, LLC, Dearborn, MI (US)

(72) Inventors: Andrey M. Ilinich, Novi, MI (US); S. George Luckey, Jr., Dearborn, MI (US); Alan John Gillard, Dearborn, MI (US); Vijitha Senaka Kiridena, Ann Arbor, MI (US)

(73) Assignee: Ford Global Technologies, Dearborn, MI (US)

( * ) Notice: Subject to any disclaimer, the term of this patent is extended or adjusted under 35 U.S.C. 154(b) by 159 days.

(21) Appl. No.: 17/372,696

(22) Filed: Jul. 12, 2021

(65) Prior Publication Data

US 2021/0331228 A1 Oct. 28, 2021

Related U.S. Application Data

(62) Division of application No. 15/660,271, filed on Jul. 26, 2017, now Pat. No. 11,090,706.

(51) Int. Cl.
*B21D 31/00* (2006.01)

(52) U.S. Cl.
CPC ..... *B21D 31/005* (2013.01)

(58) Field of Classification Search
CPC ..... B21D 7/063; B21D 11/18; B21D 22/203; B21D 31/00; B21D 31/005; B21D 35/007; B21D 39/031; B21C 37/02
See application file for complete search history.

(56) References Cited

U.S. PATENT DOCUMENTS 5,151,277 A * 9/1992 Bernardon ..... B29C 70/443 249/161
7,997,891 B2 * 8/2011 Gallagher ..... B29C 33/302 264/553
8,783,078 B2 * 7/2014 Ren ..... B21D 31/005 72/126

* cited by examiner

*Primary Examiner* — Teresa M Ekiert
(74) *Attorney, Agent, or Firm* — Burris Law, PLLC

(57) ABSTRACT

A device for incrementally forming a plurality of workpieces includes a frame configured to receive a workpiece, at least one clamp configured to secure the workpiece to the frame, a first sacrificial material layer configured to be secured to at least one surface of the workpiece, and a first forming tool configured to impart a first force directly to the first sacrificial material layer and incrementally form the workpiece to a desired geometry based on a tool path of the first forming tool. The frame, the at least one clamp, the first sacrificial material layer, and the first forming tool are configured to impart a first force directly to the first sacrificial material layer secured to at least one surface of a first workpiece with the first forming tool and incrementally form the first workpiece to a desired geometry based on a tool path of the first forming tool.

20 Claims, 5 Drawing Sheets

DEVICE TO REDUCE TOOL MARKS IN INCREMENTAL FORMING

CROSS-REFERENCE TO RELATED APPLICATIONS

This application is a divisional of and claims priority to U.S. patent application Ser. No. 15/660,271 filed on Jul. 26, 2017. The disclosure of the above application is incorporated herein by reference.

FIELD

The present disclosure relates to a method of reducing tool marks when incrementally forming a workpiece.

BACKGROUND

The statements in this section merely provide background information related to the present disclosure and may not constitute prior art.

Incremental forming is a manufacturing technique that is used to form a workpiece without associated forming dies. Generally, a workpiece is formed incrementally by two opposing forming tools, as described for example in U.S. Pat. Nos. 8,302,442, 8,322,176, 8,733,143, and 8,783,078, which are commonly assigned with the present application and the contents of which are incorporated herein by reference in their entirety.

The opposed forming tools often generate hard marks along the surfaces of the workpieces being formed, which can result in insufficient surface quality. This surface quality issue of incremental forming is addressed by the present disclosure.

SUMMARY

In one form of the present disclosure, a device for use in incrementally forming a plurality of workpieces includes a frame configured to receive a workpiece, at least one clamp configured to secure the workpiece to the frame, a first sacrificial material layer configured to be secured to at least one surface of the workpiece, and a first forming tool configured to impart a first force directly to the first sacrificial material layer and incrementally form the workpiece to a desired geometry based on a tool path of the first forming tool. In some variations, the frame, the at least one clamp, the first sacrificial material layer, and the first forming tool are configured to impart a first force directly to the first sacrificial material layer secured to at least one surface of a first workpiece with the first forming tool and incrementally form the first workpiece to a desired geometry based on a tool path of the first forming tool, for the first sacrificial material layer to be removed from the incrementally formed first workpiece and secured it to at least one surface of a second workpiece, and to impart a second force directly to the first sacrificial material layer with the first forming tool to incrementally form the second workpiece to another desired geometry based on another tool path of the first forming tool.

In some variations, the first sacrificial material layer is secured around a periphery of the first workpiece and around a periphery of the second workpiece.

In at least one variation, the device further includes at least one elastomeric material disposed between the first workpiece and the first sacrificial material layer.

In some variations, the first sacrificial material layer is a protective film.

In at least one variation, the first sacrificial material layer is metal sheet. In such variations, the metal sheet can be a low carbon steel sheet having a thickness between 0.1 mm and 1.0 mm.

In some variations, the device further includes a second sacrificial material layer secured to the frame and configured to conform to an opposite working surface of the workpiece, wherein the first and second sacrificial material layers form a space therebetween to receive the workpiece. And in at least one variations, the device further includes at least one elastomeric material disposed between at least one of the first workpiece and the first sacrificial material layer, and the first workpiece and the second sacrificial material layer. In some variations, the second sacrificial material layer is secured around a periphery of the first workpiece and around a periphery of the second workpiece, and a second forming tool opposed to the first forming tool is included. In such variations, the second forming tool is configured to impart a third force directly to the second sacrificial material layer. For example, in some variations, the second forming tool is configured to impart the third force directly to the second sacrificial material layer when the first forming tool imparts the first force directly to the first sacrificial material layer. Also, the first sacrificial material layer and the second sacrificial material layer can be each a metal sheet, for example, a low carbon steel sheet having a thickness between 0.1 mm and 1.0 mm.

In another form of the present disclosure, a device for use in incrementally forming a plurality of workpieces includes a frame configured to receive a workpiece, at least one clamp configured to secure the workpiece to the frame, a first sacrificial material layer configured to be secured to at least one surface of the workpiece and a second sacrificial material layer configured to be secured to an opposite surface of the workpiece, a first forming tool configured to impart a first force directly to the first sacrificial material layer and incrementally form the workpiece to a desired geometry based on a tool path of the first forming tool, and a second forming tool configured to impart a third force directly to the second sacrificial material layer. The frame, the at least one clamp, the first and second sacrificial material layers, and the first and second forming tools are configured to impart a first force directly to the first sacrificial material layer secured to at least one surface of a first workpiece with the first forming tool and incrementally form the first workpiece to a desired geometry based on a tool path of the first forming tool, remove the first sacrificial material layer from the incrementally formed first workpiece and secure it to at least one surface of a second workpiece, and impart a second force directly to the first sacrificial material layer with the first forming tool to incrementally form the second workpiece to another desired geometry based on another tool path of the first forming tool.

In some variations, the first sacrificial material layer and the second sacrificial material layer are secured around a periphery of the first workpiece and around a periphery of the second workpiece.

In at least one variation, the device further includes at least one elastomeric material disposed between at least one of the first workpiece and the first sacrificial material layer, and the first workpiece and the second sacrificial material layer.

In still another form of the present disclosure, a device for use in incrementally forming a plurality of workpieces includes a frame configured to receive a workpiece, a plurality of clamps configured to secure the workpiece to the frame, a first sacrificial material layer configured to be secured to at least one surface of the workpiece and a second sacrificial material layer configured to be secured to an opposite surface of the workpiece, at least one elastomeric material disposed between at least one of the first sacrificial material layer and the workpiece, and the second sacrificial material layer and the workpiece, a first forming tool configured to impart a first force directly to the first sacrificial material layer and incrementally form the workpiece to a desired geometry based on a tool path of the first forming tool, and a second forming tool configured to impart a third force directly to the second sacrificial material layer. The frame, the at least one clamp, the first and second sacrificial material layers, and the first and second forming tools are configured to impart a first force directly to the first sacrificial material layer secured to at least one surface of a first workpiece with the first forming tool and incrementally form the first workpiece to a desired geometry based on a tool path of the first forming tool, have the first and second sacrificial material layers removed from the incrementally formed first workpiece and secured to opposing surfaces of a second workpiece, and impart a second force directly to the first sacrificial material layer with the first forming tool to incrementally form the second workpiece to another desired geometry based on another tool path of the first forming tool.

In some variations, at least one of the first sacrificial material layer and the second sacrificial material layer a low carbon steel sheet having a thickness between 0.1 mm and 1.0 mm.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
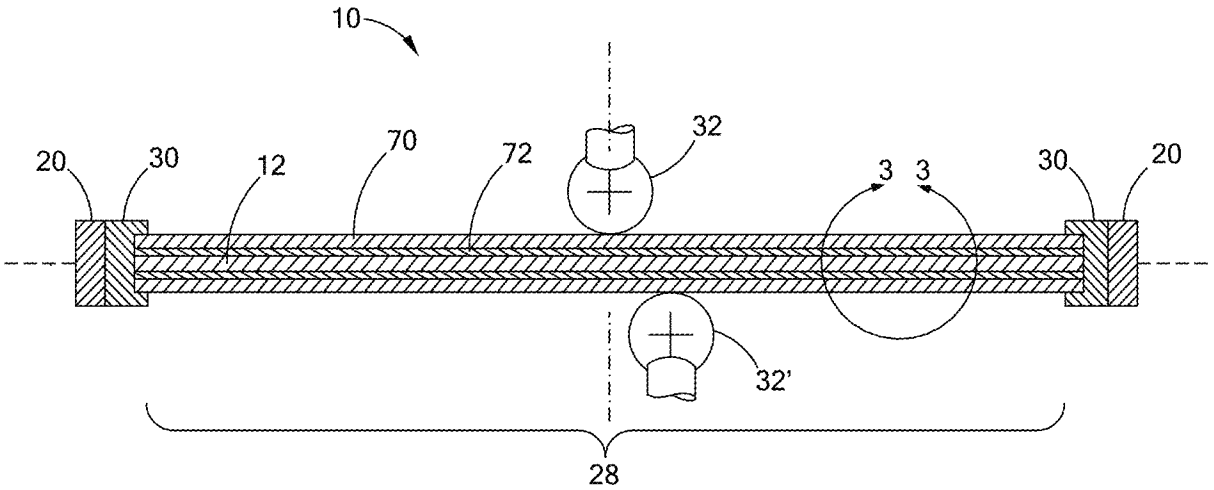
FIG. 1 is a side cross-sectional view of a workpiece and various sacrificial and elastomeric materials positioned before incremental forming.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
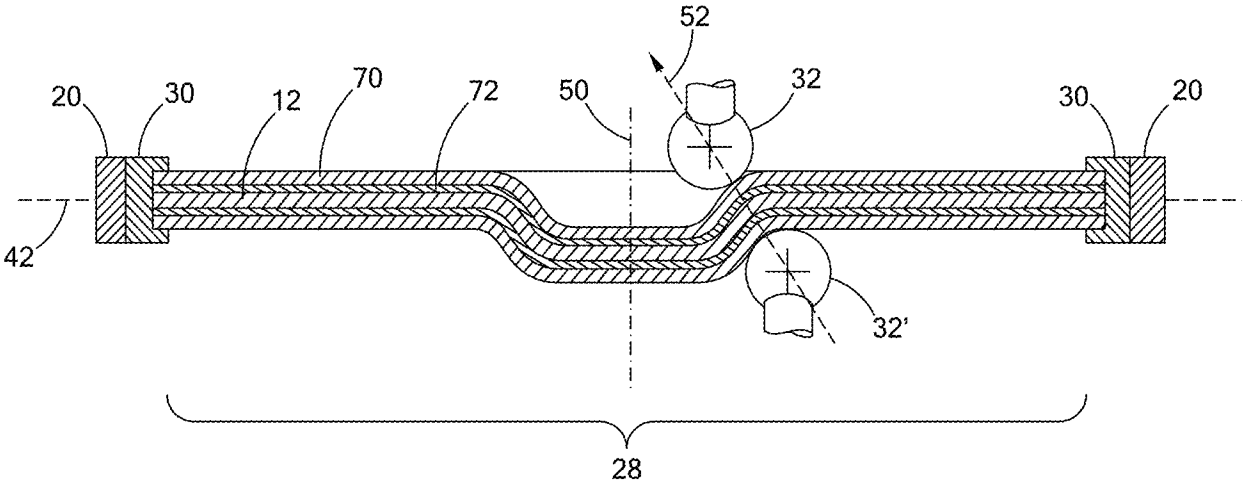
FIG. 2 is a side cross-sectional view of the workpiece and materials of FIG. 1 being incrementally formed.

Referring to FIGS. 1 and 2, a system for incrementally forming a workpiece is illustrated and generally indicated by reference numeral 10. The workpiece 12 may be made of any suitable material or materials that have desirable forming characteristics, such as a metal, metal alloy, polymeric material, or combinations thereof. In at least one form, the workpiece 12 is a metal sheet. The workpiece 12 has at least one surface 14 and may be provided in an initial configuration that is generally planar, or that is at least partially preformed into a non-planar geometry in one or more forms of the present disclosure.

Generally, in incremental forming, the workpiece 12 is formed into a desired configuration by a series of small incremental deformations. The small incremental deformations may be provided by moving one or more tools 32 and 32' along and against one or more surfaces 14 of the workpiece 12. Tool movement may occur along a predetermined or programmed path. In addition, a tool movement path may be adaptively programmed in real-time based on measured feedback, such as from a sensor such as a load cell. Thus, incremental forming may occur in increments as at least one tool (e.g., 32, 32') is moved and without removing material from the workpiece 12. More details of such a system 10 are described in U.S. Pat. Nos. 8,302,442, 8,322,176, 8,733,143, and 8,783,078 which have been incorporated herein by reference in their entirety.

The system 10 may include a plurality of components that facilitate forming of the workpiece 12, such as a frame 20, a plurality of clamps 30 disposed around a periphery of the workpiece 12, the forming tools 32 and 32', at least one sacrificial material layer 70, and optionally at least one elastomeric material 72, among other layers as described in greater detail below. The forming tools 32 and 32' should be construed as being generally synonymous with first and second forming tools throughout this specification.

The frame 20 and the clamps 30 are provided to support the workpiece 12. The frame 20 in this form is configured as a "picture frame" that at least partially defines an opening (partially shown in FIG. 1) into which the workpiece 12 is disposed. The workpiece 12 is disposed in or at least partially covers the opening when the workpiece 12 is installed within the frame 20 and secured by the clamps 30.

The clamps 30 are configured to engage and exert a clamping or holding force on the workpiece 12 so that the periphery of the workpiece 12 remains stationary during incremental forming. The clamps 30 may be provided along multiple sides of the frame 20 and may have any suitable configuration and associated geometry for holding the workpiece 12 stationary. For instance, the clamps 30 may be manually, pneumatically, hydraulically, and/or electrically actuated. Moreover, the clamps 30 may be configured to provide a fixed or adjustable amount of force upon the workpiece 12. In still another form, mechanical fasteners (not shown) may be used instead of clamps 30, among other devices for securing the workpiece 12 during incremental forming.

First and second forming tools 32, 32' have multiple degrees of freedom and are positioned according to the design specifications of the workpiece 12. The forming tools 32, 32' are configured to move along a plurality of axes, such as axes extending in different orthogonal directions like X, Y and Z axes. Note the forming tools 32, 32' may be positioned according to any coordinate system including Cartesian (X, Y, Z), cylindrical (ρ, φ, z), and spherical (ρ, θ,φ). The forming tools 32, 32' may be disposed on a spindle and may be configured to rotate about an associated axis of rotation in one or more forms of the present disclosure.

Figure 4:
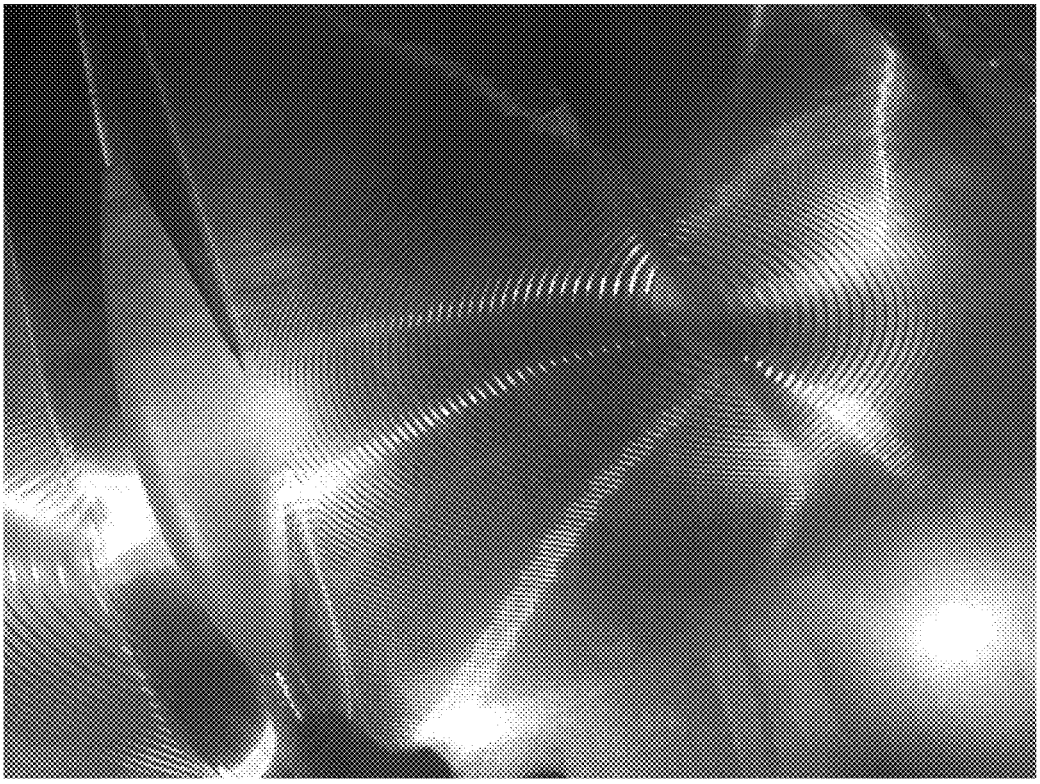
FIG. 4 PRIOR ART
FIG. 4 is a photograph of a workpiece having hard tool marks according to the prior art.

The forming tools 32, 32' impart forces to incrementally form the workpiece 12 without removing material. The forming tools 32, 32' may have any suitable geometry, including, but not limited to flat, curved, spherical, or conical shape or combinations thereof. For brevity, ball-shaped tools are depicted in the drawings and associated text. As the forming tools 32, 32' incrementally form the workpiece 12, tool marks are sometimes left upon the surface of the workpiece 12 as shown in FIG. 4. These tool marks may be unacceptable when the part has certain surface finish requirements and/or tight tolerances for its profile. Accordingly, the present disclosure addresses this issue as described in more detail in the following.

Figure 3:
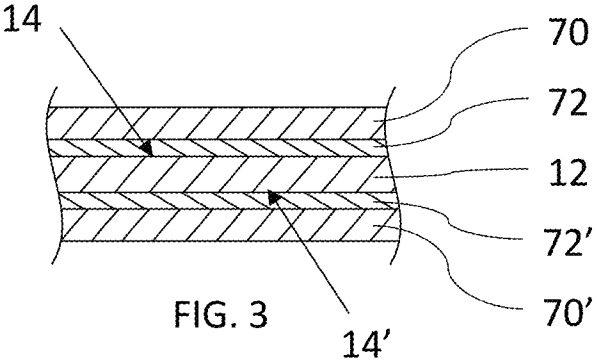
FIG. 3 is a detail view, taken from Detail 3-3 of FIG. 1, illustrating exemplary material layers used in incrementally forming the workpiece.

As shown in FIGS. 1 to 3, the sacrificial layer 70 is provided to reduce tool marks from the incremental forming process. In one form, the sacrificial layer 70 is secured to at least one surface of the workpiece 12, and at least one of the forming tools 32, 32' imparts forces directly to the sacrificial layer 70 rather than directly to the workpiece 12. During the incremental forming process, the imparted forces are transmitted through the sacrificial layer 70 to the workpiece 12. Any tool marks from the forming tools 32, 32' are thus mostly generated on the sacrificial layer 70 rather than the workpiece 12. As a result, the formed workpiece 12 has an improved surface quality, which is more suitable for certain applications.

The sacrificial layer 70 should have a low coefficient of friction to reduce friction between the forming tools 32, 32' and the sacrificial layer 70. The sacrificial layer 70 should have sufficient stiffness and rigidity to resist buckling due to friction. The sacrificial layer 70 may comprise more than one layer, as set forth in greater detail below, as it may be difficult to obtain the required combination of properties from only one sacrificial layer 70. The sacrificial layer 70 is "sacrificial" in that the sacrificial layer 70 is not incorporated into the formed workpiece 12 and is discarded or recycled after the workpiece 12 is formed. If recycled, the sacrificial layer 70 may be reused numerous times to incrementally form more than one workpiece 12 depending on the rigors of the incremental forming process to form a given workpiece 12. Sacrificial layer 70 has adequate thickness to redistribute force or pressure to the workpiece 12. However, as the thickness of the sacrificial layer 70 increases, the level of protection for the workpiece 12 increases while forming becomes more difficult and less precise.

In various forms, the sacrificial layer 70 is secured to at least one surface 14 of the workpiece 12, a plurality of sacrificial layers 70 are secured to at least one surface 14 of the workpiece 12, and a plurality of sacrificial layers 70 are secured to opposed sides of the workpiece 12, where the sacrificial layers 70 in the plurality of sacrificial layers 70 may have different thicknesses and may be different materials. For example, in one form, the sacrificial layer 70 is a low carbon steel having a thickness between 0.1 mm and 1.0 mm for a workpiece 12 thickness of between 0.5 mm and 4 mm.

In one variation as shown best in FIG. 3, a first elastomeric material 72 is secured to the surface 14 of the workpiece 12, a first sacrificial material layer (e.g., 70) is secured to the first elastomeric material 72, a second elastomeric material 72' is secured to an opposite surface 14' of the workpiece 12, and a second sacrificial material layer 70' is secured to the second elastomeric material 72'.

The elastomeric materials 72 and 72' are similarly operable to transmit forces from the forming tools 32, 32', through the first and second sacrificial material layers 70, 70', and to the workpiece 12. The elastomeric material 72 is secured to at least one surface of the workpiece 12, and thus the illustration of the second elastomeric material 72' is merely exemplary. Similarly, the sacrificial layer 70 and the elastomeric material 72 may be used on only one side of the workpiece 12 while remaining within the scope of the present disclosure. Further, it should be understood that any number of materials and layers may be employed according to the specific workpiece 12 material and geometry being incrementally formed while remaining within the scope of the present disclosure.

Because forming tools 32, 32' impart forces to the sacrificial layers 70/70' and the elastomeric materials 72/72', the formed workpiece 12 has an improved surface quality, which is more suitable for certain applications. The elastomeric material 72 may comprise more than one layer as it may be difficult to obtain the required combination of properties from one elastomeric material 72. The elastomeric material 72 should be compressible and have a Young's modulus sufficient to redistribute the compressive force and the associated contact pressure to a larger area. Elastomeric material 72 has adequate thickness to redistribute force or pressure from the forming tools 32 and 32' to the workpiece 12. However, as the thickness of the elastomeric material 72 increases the level of protection for the workpiece 12 increases while forming becomes more difficult and less precise. In various forms, the elastomeric material 72 is secured to at least one surface of the workpiece, a plurality of elastomeric materials 72 are secured to at least one surface of the workpiece, and a plurality of elastomeric materials 72/72' are secured to opposed surfaces of the workpiece, where the elastomeric material 72 may have different thicknesses, and the plurality of elastic materials may be different materials. For example, in one form, the elastomeric material 72 is a rubber having a thickness between about 0.2 mm and about 5 mm.

Lubricant may be applied to the workpiece 12, the forming tools 32 and 32', the sacrificial layer 70, and the elastomeric material 72, and combinations thereof, to improve sliding, reduce friction, and reduce shear stresses, among other benefits. Therefore, lubricant is applied to improve the incremental forming of workpiece 12 and its surface quality.

In another form, a polymer material may be used as the sacrificial layer 70, and in another form, a protective film is the sacrificial layer 70. Further, an adhesive (not shown) may be applied to the workpiece 12, the sacrificial layer 70, or the elastomeric material 72 in order to prevent slippage/movement between the workpiece 12, the sacrificial layer 70, and/or the elastomeric material 72. In one form, the adhesive is a low tack pressure sensitive adhesive.

Figure 5:
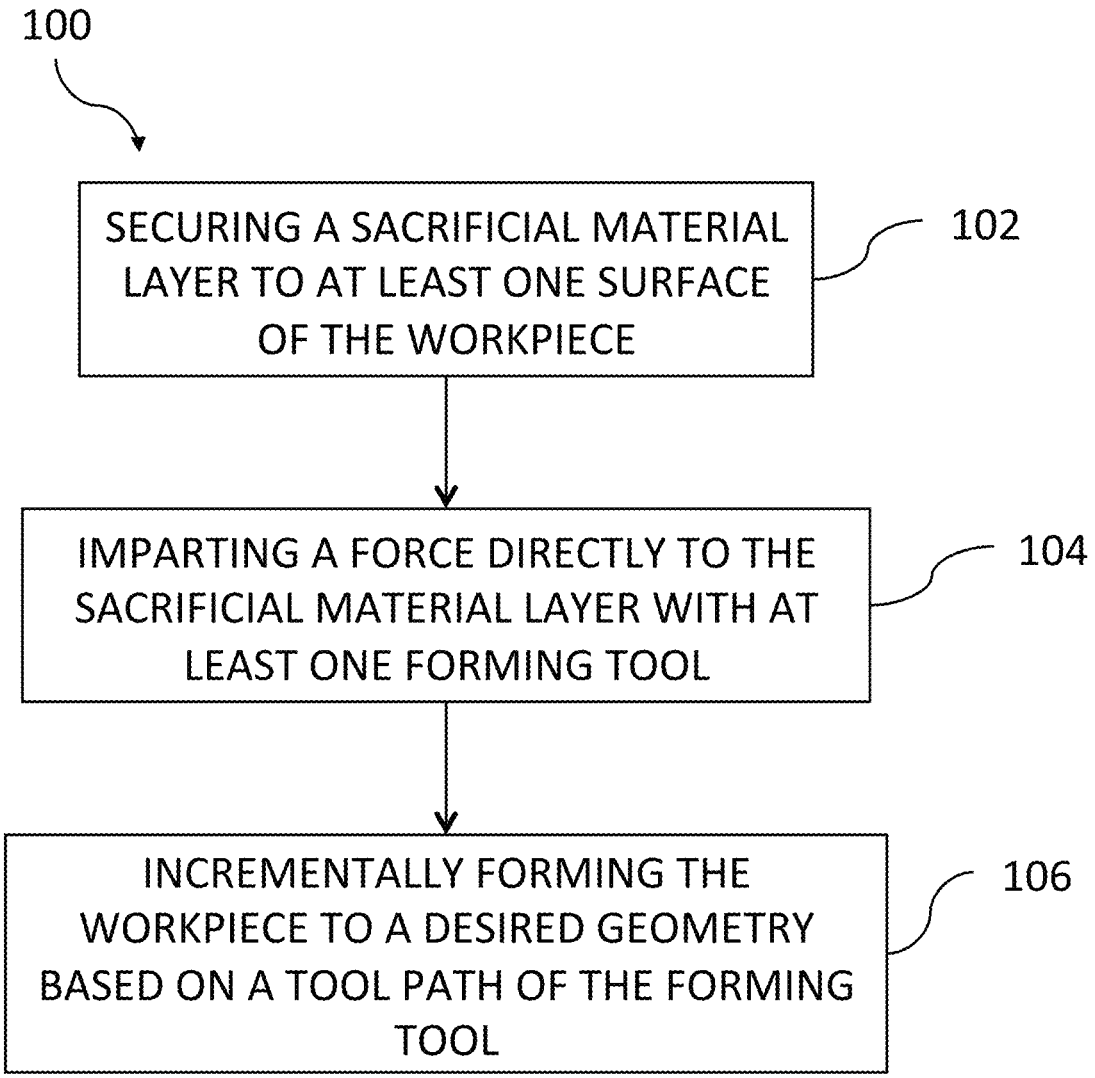
FIG. 5 is a flow diagram illustrating a method of incrementally forming a workpiece according to the teachings of the present disclosure.

Referring to a FIG. 5, a method of incrementally forming a workpiece is shown and generally indicated by reference numeral 100. At step 102, the method includes securing a sacrificial material layer to at least one surface of the workpiece. At step 104, forces are directly imparted to the sacrificial material layer with at least one forming tool. The imparted forces are transmitted through the sacrificial material layer and imparted to the workpiece. The tooling marks from the forming tool are imparted to the sacrificial layer and not the workpiece. At step 106, the workpiece is incrementally formed to a desired geometry based on a tool path of the forming tool.

Figure 6:
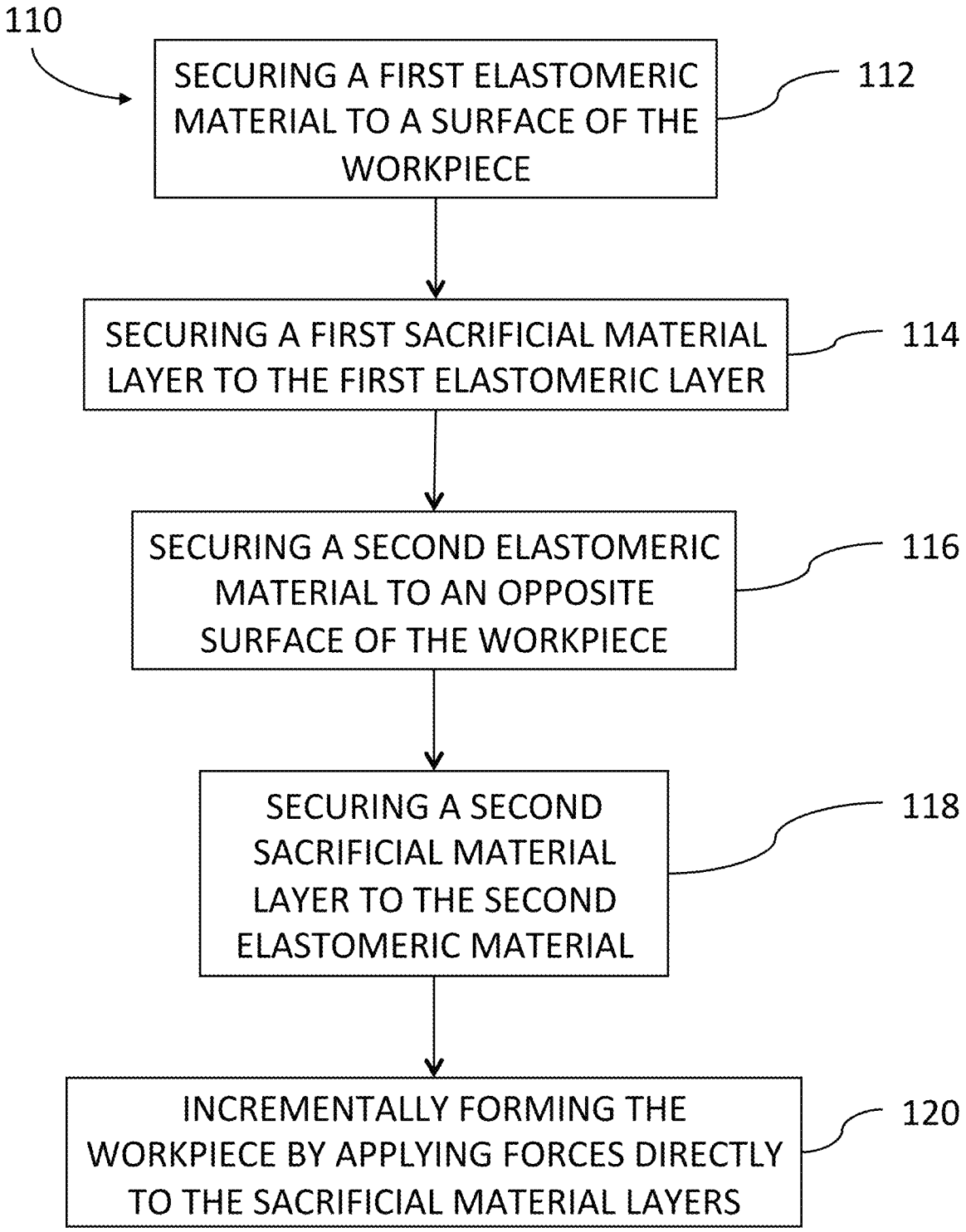
FIG. 6 is a flow diagram illustrating another method of incrementally forming a workpiece according to the teachings of the present disclosure.

Referring to a FIG. 6, another method of incrementally forming a workpiece is illustrated and generally indicated by reference numeral 110. At step 112, the method includes securing a first elastomeric material to a surface of the workpiece and then securing a first sacrificial material layer to the first elastomeric layer in step 114. Next, a second elastomeric material is secured to an opposite surface of the workpiece in step 116, followed by securing a second sacrificial material layer to the second elastomeric material in step 118. In step 120, the workpiece is incrementally formed by applying forces directly to the sacrificial material layers.

These methods can be carried out in any order of steps and are not limited to those shown herein. Also, the methods are carried out using the various materials and components (e.g., sacrificial material layers, elastomeric materials, lubricant, adhesive) as described herein with reference to FIGS. 1 to 3. Different combinations of these materials and components, their materials of construction, their order of arrangement on the workpiece 12, and the method steps carried out to incrementally form the workpiece 12, among other features, should be construed as being within the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A device for use in incrementally forming a plurality of workpieces, the device comprising:

a frame configured to receive a workpiece;

at least one clamp configured to secure the workpiece to the frame;

a first sacrificial material layer configured to be secured to at least one surface of the workpiece; and a first forming tool configured to impart force directly to the first sacrificial material layer and incrementally form the workpiece to a desired geometry based on a tool path of the first forming tool, wherein the frame, the at least one clamp, the first sacrificial material layer, and the first forming tool are configured to cooperate such that the first forming tool is configured to impart a first force directly to the first sacrificial material layer while the first sacrificial material layer is secured to at least one surface of a first workpiece and incrementally form the first workpiece to a desired geometry based on a tool path of the first forming tool;

wherein the first sacrificial material layer is configured to be removed from the incrementally formed first workpiece and secured to at least one surface of a second workpiece; and wherein the frame, the at least one clamp, the first sacrificial material layer, and the first forming tool are configured to cooperate such that the first forming tool is configured to impart a second force directly to the first sacrificial material layer to incrementally form the second workpiece to another desired geometry based on another tool path of the first forming tool.

2. The device according to claim 1, wherein the first sacrificial material layer is secured around a periphery of the first workpiece while the first forming tool imparts the first force and around a periphery of the second workpiece while the first forming tool imparts the second force.

3. The device according to claim 1 further comprising at least one elastomeric material disposed between the first workpiece and the first sacrificial material layer.

4. The device according to claim 1, wherein the first sacrificial material layer is a protective film.

5. The device according to claim 1, wherein the first sacrificial material layer is metal sheet.

6. The device according to claim 5, wherein the metal sheet is a low carbon steel sheet having a thickness between 0.1 mm and 1.0 mm.

7. The device according to claim 1 further comprising a second sacrificial material layer secured to the frame and configured to conform to an opposite surface of the workpiece, wherein the first and second sacrificial material layers form a space therebetween to receive the workpiece.

8. The device according to claim 7 further comprising at least one elastomeric material disposed between at least one of the first workpiece and the first sacrificial material layer, and the first workpiece and the second sacrificial material layer.

9. The device according to claim 7, wherein the second sacrificial material layer is secured around a periphery of the first workpiece while the first forming tool imparts the first force and around a periphery of the second workpiece while the first forming tool imparts the first force.

10. The device according to claim 7 further comprising a second forming tool opposed to the first forming tool.

11. The device according to claim 10, wherein the second forming tool is configured to impart a third force directly to the second sacrificial material layer.

12. The device according to claim 11, wherein the second forming tool is configured to impart the third force directly to the second sacrificial material layer when the first forming tool imparts the first force directly to the first sacrificial material layer.

13. The device according to claim 12, wherein the first sacrificial material layer and the second sacrificial material layer are each a metal sheet.

14. The device according to claim 13, wherein the metal sheet is a low carbon steel sheet having a thickness between 0.1 mm and 1.0 mm.

15. The device according to claim 14, wherein the at least one elastomeric material comprises a first elastomeric material disposed between the first workpiece and the first sacrificial material layer, and a second elastomeric material disposed between the first workpiece and the second sacrificial material layer.

16. A device for use in incrementally forming a plurality of workpieces, the device comprising:

a frame configured to receive a workpiece;

at least one clamp configured to secure the workpiece to the frame;

a first sacrificial material layer configured to be secured to at least one surface of the workpiece and a second sacrificial material layer configured to be secured to an opposite surface of the workpiece;

a first forming tool configured to impart force directly to the first sacrificial material layer and incrementally form the workpiece to a desired geometry based on a tool path of the first forming tool; and a second forming tool configured to impart a third force directly to the second sacrificial material layer;

wherein the frame, the at least one clamp, the first sacrificial material layer, and the first forming tool are configured to cooperate such that the first forming tool is configured to impart a first force directly to the first sacrificial material layer while the first sacrificial material layer is secured to at least one surface of a first workpiece and incrementally form the first workpiece to a desired geometry based on a tool path of the first forming tool;

wherein the first sacrificial material layer is configured to be removed from the incrementally formed first workpiece and secured to at least one surface of a second workpiece; and wherein the frame, the at least one clamp, the first sacrificial material layer, and the first forming tool are configured to cooperate such that the first forming tool is configured to impart a second force directly to the first sacrificial material layer to incrementally form the second workpiece to another desired geometry based on another tool path of the first forming tool.

17. The device according to claim 16, wherein the first sacrificial material layer and the second sacrificial material layer are secured around a periphery of the first workpiece while the first forming tool imparts the first force and around a periphery of the second workpiece while the first forming tool imparts the second force.

18. The device according to claim 16 further comprising at least one elastomeric material disposed between at least one of the first workpiece and the first sacrificial material layer, and the first workpiece and the second sacrificial material layer.

19. A device for use in incrementally forming a plurality of workpieces, the device comprising:

a frame configured to receive a workpiece;

a plurality of clamps configured to secure the workpiece to the frame;

a first sacrificial material layer configured to be secured to at least one surface of the workpiece and a second sacrificial material layer configured to be secured to an opposite surface of the workpiece;

at least one elastomeric material disposed between at least one of the first sacrificial material layer and the workpiece, and the second sacrificial material layer and the workpiece;

a first forming tool configured to impart force directly to the first sacrificial material layer and incrementally form the workpiece to a desired geometry based on a tool path of the first forming tool; and a second forming tool configured to impart a third force directly to the second sacrificial material layer;

wherein the frame, the at least one clamp, the first and second sacrificial material layers, and the first and second forming tools are configured to cooperate such that the first forming tool is configured to impart a first force directly to the first sacrificial material layer while the first sacrificial material layer is secured to at least one surface of a first workpiece and incrementally form the first workpiece to a desired geometry based on a tool path of the first forming tool;

wherein the first and second sacrificial material layers are configured to be removed from the incrementally formed first workpiece and secured to opposing surfaces of a second workpiece; and wherein the frame, the at least one clamp, the first and second sacrificial material layers, and the first and second forming tools are configured to cooperate such that the first forming tool is configured to impart a second force directly to the first sacrificial material layer to incrementally form the second workpiece to another desired geometry based on another tool path of the first forming tool.

20. The device according to claim 19, wherein at least one of the first sacrificial material layer and the second sacrificial material layer a low carbon steel sheet having a thickness between 0.1 mm and 1.0 mm.

* * * * *